US011619385B2

(12) United States Patent
Witman et al.

(10) Patent No.: US 11,619,385 B2
(45) Date of Patent: Apr. 4, 2023

(54) IGNITION SYSTEM

(71) Applicants: Thomas J. Witman, Tipp City, OH (US); Patrick W. Schatz, Tipp City, OH (US)

(72) Inventors: Thomas J. Witman, Tipp City, OH (US); Patrick W. Schatz, Tipp City, OH (US)

(73) Assignee: Hearth Products Controls Co., Miamisburg, OH (US)

( * ) Notice: Subject to any disclaimer, the term of this patent is extended or adjusted under 35 U.S.C. 154(b) by 63 days.

(21) Appl. No.: 17/181,570

(22) Filed: Feb. 22, 2021

(65) Prior Publication Data

US 2021/0262661 A1 Aug. 26, 2021

Related U.S. Application Data

(60) Provisional application No. 62/979,540, filed on Feb. 21, 2020.

(51) Int. Cl.

| | |
|---|---|
| ***F23N 1/00*** | (2006.01) |
| ***F23N 5/18*** | (2006.01) |
| *F23Q 3/00* | (2006.01) |

(52) U.S. Cl.

CPC ..... *F23N 1/005* (2013.01); *F23N 5/187* (2013.01); *F23N 2005/185* (2013.01); *F23N 2225/16* (2020.01); *F23N 2229/12* (2020.01); *F23Q 3/008* (2013.01)

(58) Field of Classification Search

CPC ..... F23N 2235/14; F23N 2227/00; F23N 2227/16; F23N 2227/18; F23N 2227/28; F23N 2227/32; F23N 2227/34; F23N 2227/36; F23N 2227/38; H01T 15/00; G01R 19/165; F23Q 3/006; F23Q 3/008; F23Q 7/22; F23Q 7/24; F23D 2207/00; F23D 2208/00

USPC ..... 431/6, 24, 66; 361/253, 264

See application file for complete search history.

(56) References Cited

U.S. PATENT DOCUMENTS

| | | | | | |
|---|---|---|---|---|---|
| 3,277,949 | A | * | 10/1966 | Walbridge | F23N 5/203 327/494 |
| 3,584,987 | A | * | 6/1971 | Michaels | F23Q 9/14 431/66 |
| 3,594,107 | A | * | 7/1971 | Willson | F23Q 7/12 431/66 |
| 3,762,856 | A | | 10/1973 | Alessio | |
| 3,871,814 | A | * | 3/1975 | Das | F23N 5/20 431/66 |
| 3,975,136 | A | * | 8/1976 | Baysinger | F23N 5/123 431/74 |

(Continued)

FOREIGN PATENT DOCUMENTS

| | | |
|---|---|---|
| GB | 1289489 | 9/1972 |

*Primary Examiner* — Avinash A Savani

(74) *Attorney, Agent, or Firm* — Thompson Hine LLP

(57) ABSTRACT

A system including a burner configured to be coupled to a fuel line to deliver fuel to the burner and an igniter positioned adjacent to the burner and configured to ignite fuel emitted by the burner. The system further includes a valve configured to control a flow of fuel through the fuel line and a control module operably coupled to the igniter and to the valve. The control module is configured to send a signal to the igniter and to close the valve if a quality of a return electrical signal from the igniter is below a predetermined value.

21 Claims, 3 Drawing Sheets

(56) References Cited

U.S. PATENT DOCUMENTS 4,002,419 A * 1/1977 Hantack ..... F23Q 7/08 431/67
4,019,853 A * 4/1977 Sears ..... F23N 5/20 431/67
4,304,545 A 12/1981 Matthews
4,405,299 A * 9/1983 Serber ..... F23N 5/123 431/78
4,863,372 A * 9/1989 Berlincourt ..... F23Q 3/004 431/73
5,575,638 A * 11/1996 Witham ..... F24C 3/126 431/73
5,951,276 A * 9/1999 Jaeschke ..... F23Q 7/12 431/66
5,957,681 A * 9/1999 Hansen ..... F23G 7/085 431/353
6,217,312 B1 * 4/2001 Levinson ..... F23Q 7/10 361/264
6,418,882 B1 * 7/2002 Trant ..... F24H 9/1836 110/162
8,747,102 B2 6/2014 Boguszewski et al.
9,068,752 B2 * 6/2015 Shaffer ..... F24C 3/103
9,546,788 B2 1/2017 Strong
9,863,635 B2 1/2018 Boguszewski et al.
10,151,493 B2 12/2018 French et al.
2003/0064335 A1 * 4/2003 Canon ..... F24C 3/103 431/72
2006/0175306 A1 * 8/2006 Prociw ..... F02C 7/264 219/121.57
2007/0224560 A1 * 9/2007 Stainrod ..... F24C 3/006 431/263
2009/0104573 A1 * 4/2009 Chen ..... F24C 3/126 431/255
2010/0255433 A1 * 10/2010 Querejeta Andueza ..... F23N 5/146 431/12
2012/0258412 A1 * 10/2012 Jackow ..... F23D 14/60 431/254
2014/0080072 A1 * 3/2014 Smirnov ..... F23D 14/66 431/6
2021/0102700 A1 * 4/2021 Billman ..... F24C 3/126

* cited by examiner

IGNITION SYSTEM

This application claims priority to U.S. Provisional Patent Application Ser. No. 62/979,540, filed on Feb. 21, 2020, the entire contents of which are hereby incorporated by reference.

This application is directed to an ignition system for fires and fire effect systems, such as indoor or outdoor fire pits and fireplaces.

BACKGROUND

Fire effect systems, such as fire pits or fireplaces, typically burn combustible fuel such as liquid propane, natural gas or other fuels. The fire effect system may use an electronic igniter, such as a hot surface igniter, in combination with a pilot light and a flame sensing feature such as a thermocouple sensor or rectification flame sensor. The igniter is placed in close proximity to the pilot light to light the pilot when startup is desired. The pilot light, in turn, lights a main burner, and continued burning of the pilot light also helps to eliminate any buildup of flammable fuel.

Such systems can be configured to block the flow of fuel if a loss of flame is detected. In particular, the flame sensing feature in existing system can be used to sense a flame of the pilot light to detect whether the pilot light is lit or unlit. The flame sensing feature can be placed close or within the scope of the pilot flame and sends an electrical signal when a pilot flame is present. If a predetermined electrical value (e.g. a millivolt value) is reached and maintained, this is taken as indicating the presence of a pilot flame, which in turn causes the energization of an electronic module. Energization of the electronic module can in turn energize (i.e., open) a valve to supply fuel for ignition of the main burner. If the pilot flame is extinguished, the thermocouple will not return the corresponding signal and the fuel valve will close.

One drawback with this system is that soot can build up on the thermocouple, which can gradually thermally insulate the thermocouple and reduce its ability to accurately detect the presence of a pilot flame. In addition existing systems can include a relatively high number of components and complexity.

SUMMARY

In one embodiment, the present system is an ignition system that is relatively simple and provides predictable arc or spark generation. More particularly, in one embodiment the invention is a system including a burner configured to be coupled to a fuel line to deliver fuel to the burner and an igniter positioned adjacent to the burner and configured to ignite fuel emitted by the burner. The system further includes a valve configured to control a flow of fuel through the fuel line and a control module operably coupled to the igniter and to the valve. The control module is configured to send a signal to the igniter and to close the valve if a quality of a return electrical signal from the igniter is below a predetermined value.

DETAILED DESCRIPTION

Figure 1:
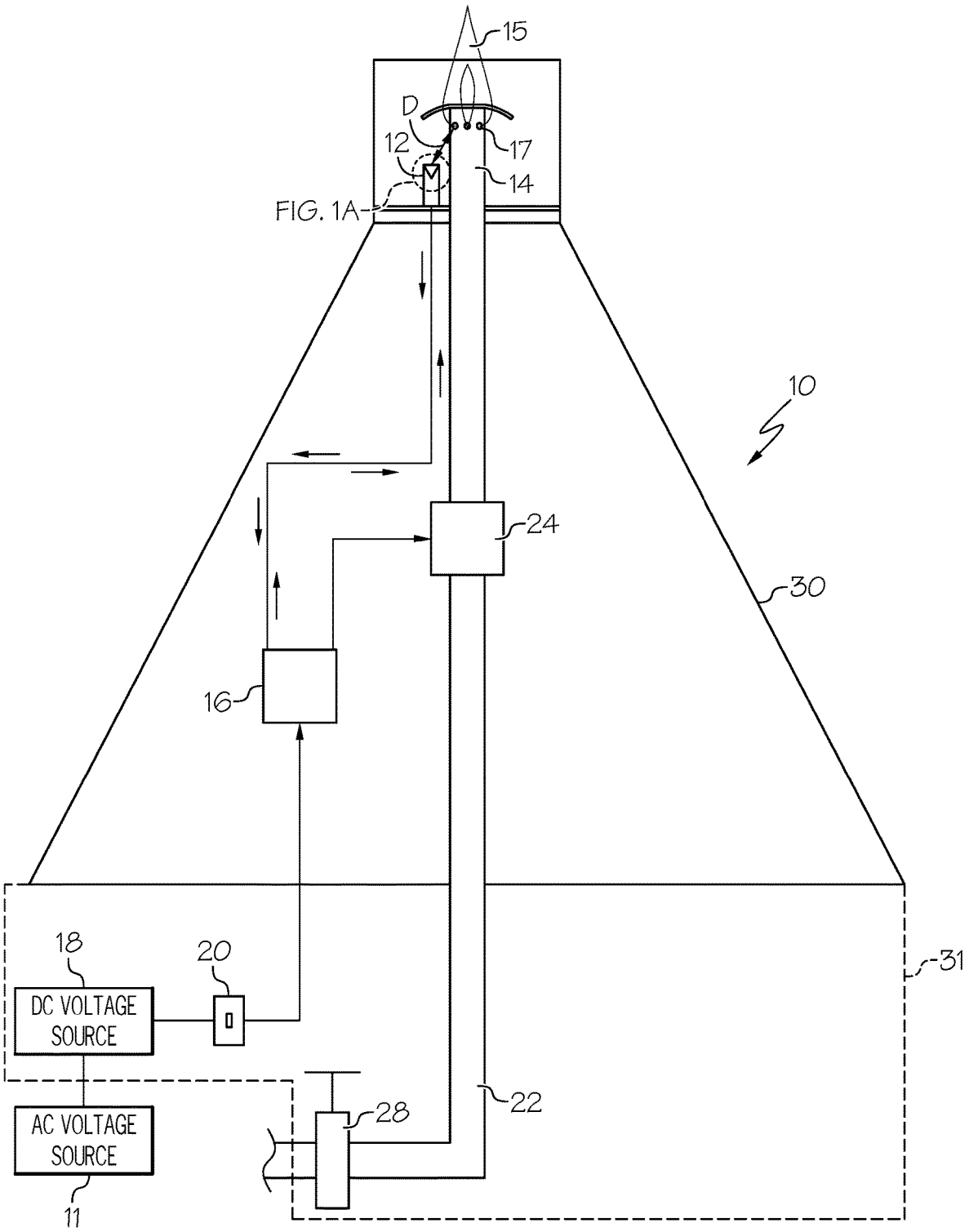
FIG. 1 is a schematic of a fire effect system utilizing an ignition system according to one embodiment.

Referring to FIG. 1, a fire effect system 10 according to an embodiment is schematically shown in the form of a pole mounted torch, such as a tiki torch. The system 10 includes an igniter 12, which may be a plasma arc igniter in one case, positioned in relatively close proximity to a burner 14 having one or more burner holes 17 at its distal end through which fuel is configured to escape for combustion. The burner 14 is in fluid communication with, and receives fuel from, a supply line or fuel line 22 which can be coupled to a fuel source (not shown) such as a municipal or utility company fuel source infrastructure, or a local tank or container. The fuel supplied by and flowing through the supply line 22 can be nearly any combustible fuel, or more specifically in one case any carbon-based or petroleum based fuel, such a (gaseous) natural gas, (liquid) propane, methane or butane.

A valve or supply valve 24 is positioned in the fuel line 22 to control the flow of fuel therethrough. In particular, the valve 24 is movable moved between an open position, in which fuel is allowed to flow through the valve 24 and supply line 22, and a closed position wherein the valve 24 blocks fuel from flowing through the valve 24 and supply line 22.

The system 10 can be coupled to a standard AC electrical source 11, such as a 120 volt, 50/60 Hz electrical system from for example a municipal or utility company electrical source. The system 10 can include a voltage source 18 electrically coupled to an alternate voltage source 11, where the voltage source 18 takes the form of, for example, a standard transformer that coverts a supplied or input voltage to an adjusted voltage, such as thirty volts in one case. The voltage source 18 is electrically coupled to a control module 16, which will be described in greater detail below, and which selectively provides power to the igniter 12 and also controls the valve 24. The power provided to the igniter 12 from the control module 16 can be further stepped down to a lower voltage, for example three or four volts, in one case at the control module 16. The control module 16 is electrically/operatively connected to the voltage source 18 through a switch 20, such as a relay switch or on/off switch which can be manually operated by a user.

Figure 1A:
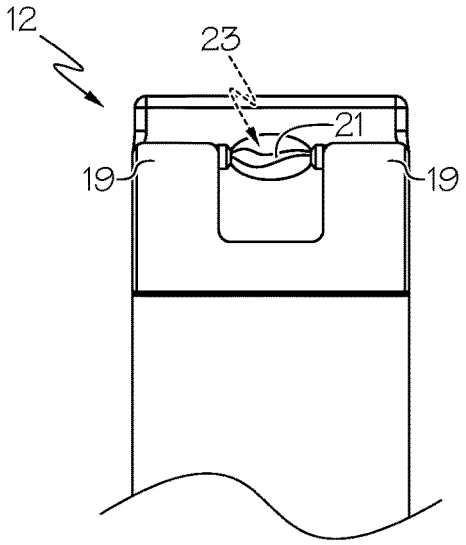
FIG. 1A is a detail view of the area indicated in FIG. 1.

The igniter 12 can in one case take the form of plasma arc igniter which include a pair of electrodes 19 (see FIG. 1A) with a gap 23 positioned therebetween. The igniter 12 can include or be operatively coupled to components (not shown) that significantly step up the voltage provided by control module 16, including in one case by a flyback transformer in conjunction with a MOSFET. The resultant high voltage, such as between about 8,000-10,000 volts in one case, or at least about 6,000 volts in one case, or at least about 8,000 volts in another case, is then applied to the electrodes 19, which causes an arc or spark 21 to form, spanning the electrodes 19. The arc 21 can be continuously maintained as long as sufficient voltage is applied to the electrodes 19. In this manner the arc 21 can be generated and maintained for significant periods of time, and as long as desired in some cases. Thus the arc 21 can be continuously maintained for at least about 0.1 seconds in one case, or at least about 0.5 seconds in another case, or at least about 1 second in yet another case. In some cases, a spark, which is in existence for a relatively short period of time, may be created instead of or in place of the arc. The spark can, in some cases, be created with a relatively high frequency and may take the appearance of a continuous arc.

The arc or spark 21 can be relatively hot, having a temperature of approximately 2000° F. in one case, and can range from between about 1500° F. to about 2500° F. in some cases, or be greater than about 1200° F. in one case, or greater than about 1500° F. in one case. Natural gas ignites at approximately 1000° F. and liquid propane ignites at approximately 1150° F. Thus the relatively high temperature of the arc 21 can be greater than the fuel ignition temperatures, including a margin of error, which helps to ensure consistent, predictable and repeatable ignition and burning of the fuel. The resultant arc 21 is also resistant to the effects of wind due to its strong electrical core.

The relatively high ignition temperature of the arc 21 also enables the igniter 12 to be placed at a further distance from the burner 14 as compared to other systems, which can extend the life of the igniter 12, since it is avoids long-term exposure to the flame 15 and minimizes soot build-up. As can be seen in FIG. 1, the igniter 12 can be placed laterally to the side of, and/or vertically offset from, the distal end of the burner 14 and/or the burner holes 17. In the illustrated embodiment the igniter 12 is positioned below the burner 14 and/or burner holes 17, but if desired could instead be positioned above the burner 14 and/or burner holes 17. In one case, the total distance D between the igniter 12 and the burner 14 and/or burner holes 17 is between about 1/16" and about 2", or in another case between about ¾" and about 1½", or greater than about 1/16" in one case, or greater than about ¾" in another case, or greater than about ½" in another case, or less than about 2" in one case, or less than about 1" in yet another case.

An adjustment valve 28 can be positioned in the supply line 22 to adjust the flow of fuel through the supply line 22, and thereby adjust the size of the flame 15 at the burner 14. The adjustment valve 28 may also be able to be closed to block the flow of fuel through the supply line 22. In the illustrated embodiment, the igniter 12, burner 14, control module 16, valve 24 and distal end of the supply line 22 are located in a housing 30, which takes the form of a generally conical portion of a tiki torch in the particular illustrated embodiment. However the housing 30 can have any of wide variety of shapes and configurations. The system 10 can also be included/housed in an outer casing 31, shown schematically in FIG. 1 and which can take the form of a pole of a tiki torch. The housing 30 can be coupled to and/or part of the outer casing 31. However the fire effect system 10 can take a wide variety of configurations besides tiki torches, such as nearly any fire effect system or fire/flame system including fire pits, fireplaces and the like.

The control module 16 can be or include any one of a controller, micro-controller, computer, processor, circuitry, ASIC, IC, microchip, microchip smart device, programmable logic controller, dedicated microchip-sets with predetermined settings, inductive controllers or the like with internal logic (either hardware or software, or other computer readable storage media which can be non-transitory computer-readable instructions, data structure, program modules or other data) to receive inputs, carry out calculations, and provide outputs in the manner described herein. Further details with respect to the control module 16 are also provided below.

Figure 2:
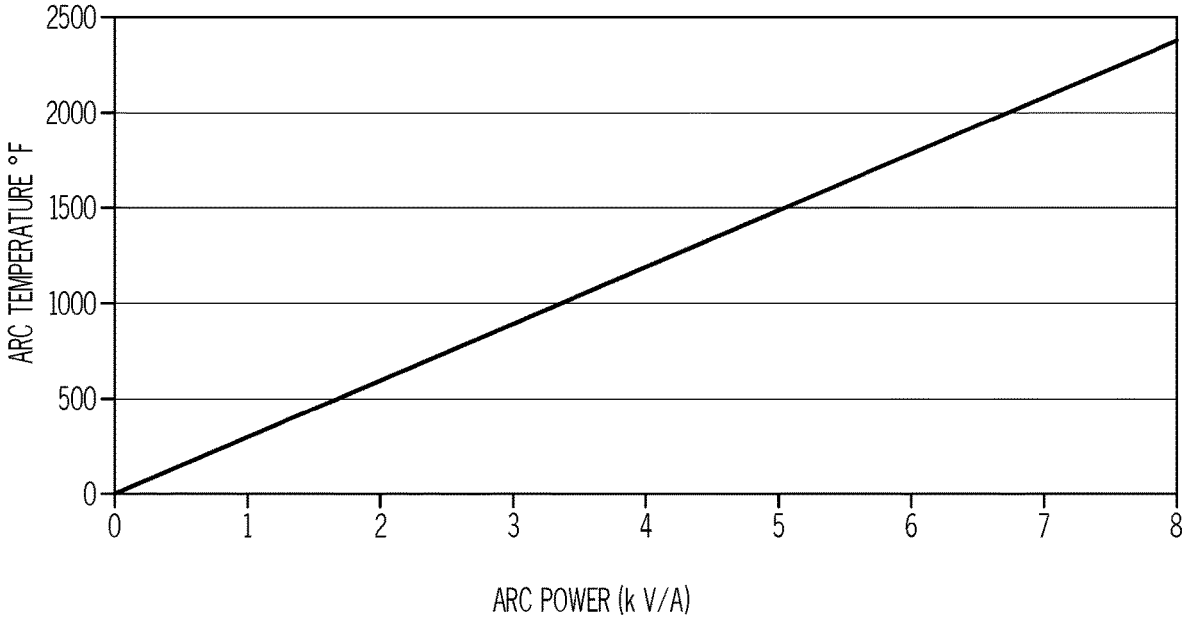
FIG. 2 is a graph depicting a relationship of temperature of the arc of an igniter as a function of the input power.

With reference to FIG. 2, the temperature of the arc 21 can be roughly or directly proportional to, or otherwise related to, the strength of the input electrical signal, such as power and/or voltage and/or current across the electrodes 19. Thus, in general, the more power (and/or voltage and/or amps) that is applied to the igniter 12, the greater the temperature of the arc 21, with a high level of predictability and confidence. Conversely a decrease in input power provides a resultant a decrease in the temperature of the arc 21.

When it is desired to provide a flame 15 at the burner 14, the switch 20 is turned on (if not already on) to ensure power is provided to the control module 16, igniter 12, and valve 24. The adjustment valve 28 is also opened (if not already open) to ensure a proper flow of fuel through the supply line 22, A user/operator then sends a signal to the control module 16, such as by pressing a button, activating a lever, sending a wireless signal or the like, indicating that the igniter 12/burner 14 is desired to be activated.

The valve 24 is electrically/operatively coupled to, and can be opened and closed by, the control module 16, which as noted above is also operatively coupled to the igniter 12. Accordingly when the valve 24 is so activated the control module 16 sends a signal and/or voltage to the valve 24 to cause the valve 24 to open. The control module 16 also sends a signal and/or voltage to the igniter 12 to cause the igniter 12 to generate an arc 21 to thereby ignite fuel emitted by the burner 14 through the holes 17. Because the input power provided to the igniter 12 can cause the igniter 12 to generate an arc 21 at a high temperature, it can be known with a high level of confidence that any fuel at the burner 14 is ignited and burning.

The control module 16 can operate the igniter 12 to periodically ignite at regular intervals (e.g., every three to four seconds in one case) and stay on for a short period (e.g., one to two seconds in one case) to ignite any fuel around the igniter 12/burner 14, even if it is known or assumed that the burner 14 is burning fuel. By periodically operating the igniter 12, if the flame 15 at the burner 14 is extinguished for some reason the flame 15 will be reignited within a relatively short period of time when the next arc or spark 21 is automatically generated by the igniter 12. In one case the igniter 12 remains on for two seconds, off for four seconds, on for two seconds, off for four seconds, and so on, throughout the operation of the fire effect system 10, although the timing and duration of arc generation can vary as desired.

The control module 16 measures a quality of the electrical signal (where the measured quality can be voltage and/or current and/or power, or other electrical qualities) returning back from the igniter 12 (e.g. feedback) in the closed loop circuit to confirm that sufficiently strong electrical input was provider to the igniter 12 to ensure the arc/spark 21 was strong and/or hot enough to ignite the flame 15. With reference again to FIG. 2, if the measured return power and/or voltage and/or current is not sufficiently strong (i.e., drops below a predetermined threshold that is sufficient for proper gas ignition), the control module 16 is configured to turn off the valve 24 to avoid a buildup of fuel. In addition, the measured quality of the return electrical signal can be used to adjust the input (supplied) electrical signal to ensure the arc/spark 21 is generated with the desired qualities, such as temperature, in a feedback loop.

According to one embodiment, the nominal return power from the igniter 12 that is indicative of a sufficiently strong arc 21 for proper gas ignition is approximately 7 kV/A. Return voltage, amperage, or other electrical qualities can also or instead be measured. If the measured electrical quality is below the threshold value, the control module 16 will close the valve 24 and thereby terminate the supply of fuel because it may be assumed that the arc 21 or spark generated by the igniter 12 may not be sufficiently strong to ignite a flame 15. In this case, the system 10 may, after a predetermined period of time, run the ignition sequence again by opening the valve 24, providing power to the igniter 12 and measuring the return power. In yet another case, after sensing an insufficient return electrical signal, the system 10 may remain shut down until manually actuated by a user and/or until it is confirmed that the system 10 has been inspected and/or repaired. Conversely, if desired the control module 16 may be programmed to close the valve 24 if the measured igniter return electrical signal exceeds a maximum value.

Figure 3:
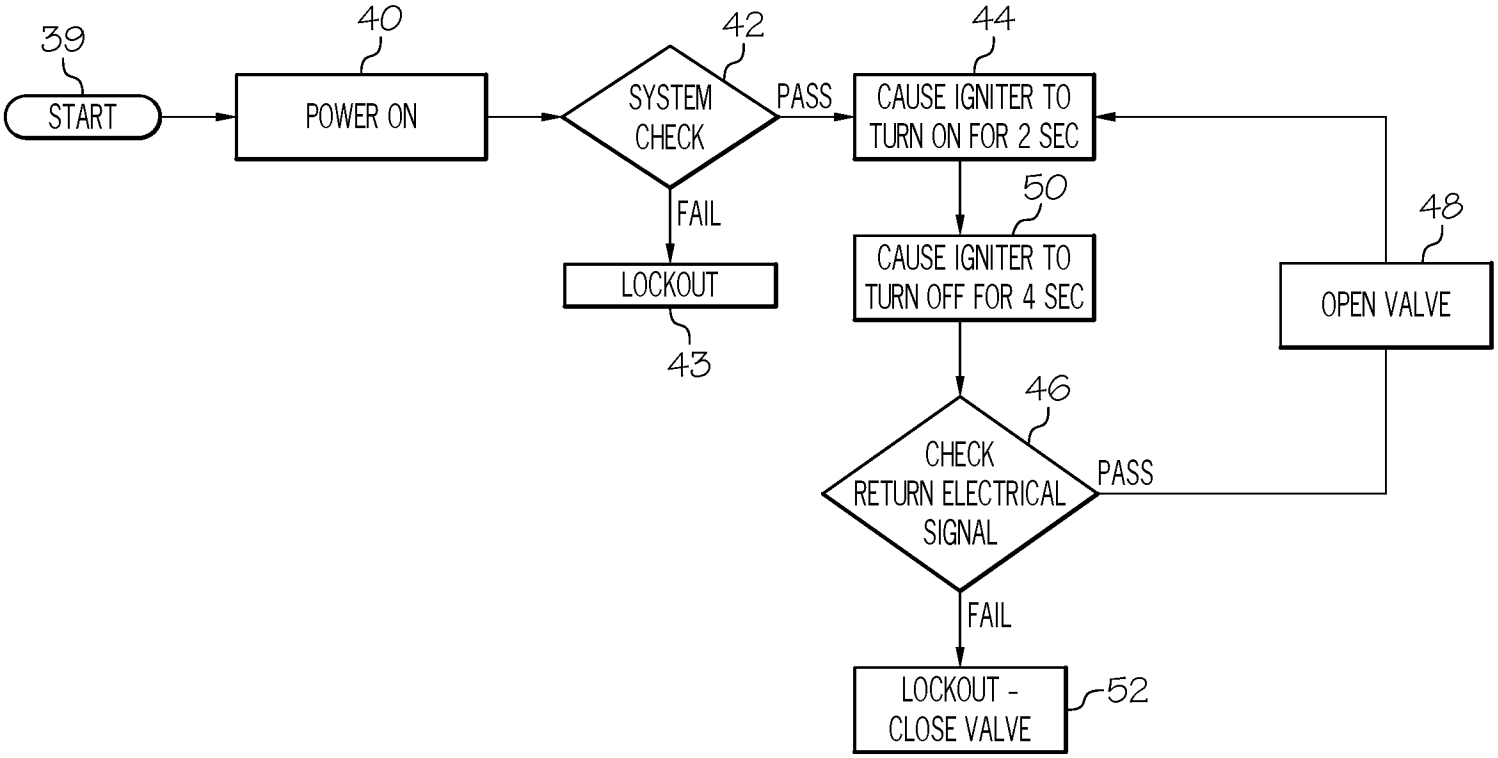
FIG. 3 is a flow chart illustrating a high-level summary of certain steps for ignition control.

With reference to FIG. 3, a summary of the ignition sequence carried out by at least one embodiment is shown. After starting at step 39, at step 40 power is supplied to the control module 16 by, in one case, closing the switch 20. At step 42 the control module 16 will then perform a system check to verify that the circuit and electrical components of the system 10 are functioning properly. If, at step 42, the initial system check fails, the control module 16 will lockout the system at step 43, and the valve 24 is closed or remains closed. Otherwise the system proceeds to step 44 and the control module 16 will cause the igniter 12 to generate an arc 21/spark for a predetermined period of time (two seconds in one case). After step 44 the control module 16 can cause the igniter 12 to remain off for a predetermined period of time (four seconds in one case) in step 50 to allow the system 10 to rest and/or recharge and/or conserve electricity and/or reduce wear and tear. At step 46 the control module 16 measures the return igniter electrical signal to determine if the measured return power, voltage, amps, etc. are sufficient. If the predetermined electrical signal strength requirement is met, then the ignition sequence will continue at step 48 by opening (or retaining open) the valve 24. In contrast, if the predetermined electrical signal strength requirement is not met at step 46, the system proceeds to step 52, where the system 10 is locked out and the valve 24 is closed.

Each time the igniter 12 is turned on at step 44, the control module 16 will again at step 46 check the return electrical strength signal to determine if it is within acceptable limits. If the measured value(s) is either above a predetermined maximum or below a predetermined minimum, the control module 16 will shut the valve 24 at step 52 to prevent the unsafe buildup of fuel.

The system 10 disclosed herein does not require, and thus can eliminate and may not include, a pilot light, pilot burner or pilot flame, and also a flame detector/flame sensing feature, such as a thermocouple flame detection sensor or rectification flame sensor used in other ignition systems. Thus the current system 10 can lack any flame detection systems or hardware, and lack a pilot light (or any second burner positioned adjacent to the burner 14 that is configured to ignite fuel emitted by the burner 14). Due to the predictable relationship between applied power and temperature at the igniter 12, and the measuring of the return electrical signal, it can be known whether ignition has occurred and the valve 24 controlled accordingly. By eliminating the pilot light and flame detector, cost, complexity and part count can be reduced.

The control module 16 can be capable of executing the software components described herein for the sending/receiving and processing of tasks for the various components. The software components can be stored on a tangible medium, such as memory, on a hard drive, on a compact disc, RAM memory, flash drive, etc., which tangible medium can exclude signals, such as transitory signals and/or non-statutory transitory signals. The control module 16 can be a server computer, workstation, desktop computer, laptop, or other computing device, and may be utilized to execute any aspects of the software components or functionality presented herein. The control module 16 can include a baseboard, or "motherboard," which is a printed circuit board to which a multitude of components or devices may be connected by way of a system bus or other electrical communication paths. In one illustrative embodiment, one or more central processing units (CPUs) operate in conjunction with a chipset. The CPUs can be programmable processors that perform arithmetic and logical operations necessary for the operation of the control module 16.

The CPUs can perform operation by transitioning from one discrete, physical state to the next through the manipulation of switching elements that differentiate between and change these states. Switching elements may generally include electronic circuits that maintain one of two binary states, such as flip-flops, and electronic circuits that provide an output state based on the logical combination of the states of one or more other switching elements, such as logic gates. These basic switching elements may be combined to create more complex logic circuits, including registers, adders-subtractors, arithmetic logic units, floating-point units, or the like.

The chipset provides an interface between the CPUs and the remainder of the components and devices on the baseboard. The chipset may provide an interface to a memory. The memory may include a random access memory (RAM) used as the main memory in the control module 16. The memory may further include a computer-readable storage medium such as a read-only memory (ROM) or non-volatile RAM (NVRAM) for storing basic routines that that help to startup the control module 16 and to transfer information between the various components and devices. The ROM or NVRAM may also store other software components necessary for the operation of the control module 16 in accordance with the embodiments described herein.

The control module 16 may be connected to at least one mass storage device that provides non-volatile storage for the control module 16. The mass storage device may store system programs, application programs, other program modules, and data, which are described in greater detail herein. The mass storage device may be connected to the control module 16 through a storage controller connected to the chipset. The mass storage device may consist of one or more physical storage units. The storage controller may interface with the physical storage units through a serial attached SCSI (SAS) interface, a serial advanced technology attachment (SATA) interface, a fiber channel (FC) interface, or other standard interface for physically connecting and transferring data between control modules and physical storage devices.

The control module 16 may store data on the mass storage device by transforming the physical state of the physical storage units to reflect the information being stored. The specific transformation of physical state may depend on various factors. Examples of such factors may include, but are not limited to, the technology used to implement the physical storage units, whether the mass storage device is characterized as primary or secondary storage, or the like. For example, the control module 16 may store information to the mass storage device by issuing instructions through the storage controller to alter the magnetic characteristics of a particular location within a magnetic disk drive unit, the reflective or refractive characteristics of a particular location in an optical storage unit, or the electrical characteristics of a particular capacitor, transistor, or other discrete component in a solid-state storage unit. Other transformations of physical media are possible without departing from the scope and spirit of the present description, with the foregoing examples provided only to facilitate this description. The control module 16 may further read information from the mass storage device by detecting the physical states or characteristics of one or more particular locations within the physical storage units.

In some embodiments, the mass storage device may be encoded with computer-executable instructions that, when loaded into the control module 16, transforms the control module 16 from being a general-purpose computing system into a special-purpose computer capable of implementing the embodiments described herein. These computer-executable instructions transform the control module 16 by specifying how the CPUs transition between states, as described above. In further embodiments, the control module 16 may have access to other computer-readable storage medium in addition to or as an alternative to the mass storage device. In some cases, the control module 16 may be able to provide outputs to and receive input via a short-range wireless communications technology standard, such a Bluetooth® communication standards, to enable users to control the control module 16 via their mobile devices.

Having described the invention in detail and by reference to the various embodiments, it should be understood that modifications and variations thereof are possible without departing from the scope of the claims of the present application.

What is claimed is:

1. A system comprising:

a burner configured to be coupled to a fuel line to deliver fuel to the burner;

a plasma arc igniter positioned adjacent to the burner and configured to ignite fuel emitted by the burner;

a valve configured to control a flow of fuel through the fuel line; and a control module operably coupled to the plasma arc igniter and to the valve, wherein the control module is configured to apply an input electrical signal to generate an arc across the plasma arc igniter, measure an electrical current signal indicating ignition signal strength of the input electrical signal, and adjust the input electrical signal if a quality of the electrical current signal is determined to be greater than or less than a predetermined signal strength value.

2. The system of claim 1 wherein the arc is configured to ignite the fuel emitted by the burner.

3. The system of claim 2 wherein the control module is configured to periodically apply the input electrical signal to the igniter regardless of whether the burner is burning fuel.

4. The system of claim 1 wherein the control module is configured to measure the quality of the electrical current signal.

5. The system of claim 1 wherein the quality of the electrical current signal is related to a strength of the arc.

6. The system of claim 1 wherein the igniter is configured to, when ignited, maintain the arc continuously at a temperature of at least about 1200 degrees Fahrenheit.

7. The system of claim 1 wherein the igniter is configured to receive the input electrical signal at a given power, and in response, generate the arc at a temperature that is directly related to the given power of the input electrical signal.

8. The system of claim 1 wherein the control module is configured to close the valve if the quality of the electrical current signal is above an additional predetermined signal strength value.

9. The system of claim 1 wherein the burner has at least one hole through which fuel is configured to escape from the burner for combustion, and wherein the igniter is positioned at least about 1/16" away from the at least one hole.

10. The system of claim 1 wherein the system lacks a pilot burner and lacks a flame detector.

11. The system of claim 1 wherein the control module is at least one of a controller, micro-controller, computer, processor, circuitry, ASIC, IC, microchip, microchip smart device, programmable logic controller, dedicated microchipset or inductive controllers.

12. A system comprising:

a burner configured to be coupled to a fuel line to deliver fuel to the burner;

a plasma arc igniter positioned adjacent to the burner and configured to ignite fuel emitted by the burner;

a valve configured to control a flow of fuel through the fuel line; and a control module operably coupled to the plasma arc igniter and to the valve, wherein the control module is configured to apply an input electrical signal to generate an arc across the plasma arc igniter to cause the igniter to ignite the emitted fuel, measure an electrical current signal indicating ignition signal strength of the input electrical signal, and adjust the input electrical signal if a quality of the electrical current signal is determined to be greater than or less than a predetermined signal strength value, wherein the system lacks a pilot burner and lacks a flame detector.

13. The system of claim 12 wherein the control module is configured to close the valve if the quality of the electrical current signal is determined to be greater than or less than the predetermined signal strength value.

14. The system of claim 13 wherein the control module is configured to periodically send the input electrical signal to the plasma arc igniter regardless of whether the burner is burning fuel, wherein the quality of the electrical current signal is associated with at least one of power, voltage or current, wherein the plasma arc igniter is configured to, when ignited, maintain the arc continuously at a temperature of at least about 1200 degrees Fahrenheit, and wherein the plasma arc igniter is configured to receive the input electrical signal at a given power, and in response, generate the arc at a temperature that is directly related to the given power of the signal.

15. A system comprising:

a burner configured to be coupled to a fuel line to deliver fuel to the burner;

a plasma arc igniter positioned adjacent to the burner and configured to ignite fuel emitted by the burner;

a valve configured to control a flow of fuel through the fuel line; and a control module operably coupled to the plasma arc igniter and to the valve, wherein the control module is configured to periodically apply an input electrical signal to the plasma arc igniter to cause the plasma arc igniter to generate an arc, regardless of whether the burner is burning fuel, measure an electrical current signal indicating ignition signal strength of the input electrical signal, and adjust the input electrical signal if a quality of the electrical current signal is determined to be greater than or less than a predetermined signal strength value.

16. The system of claim 15 wherein the control module is configured to close the valve if the quality of electrical current signal from the plasma arc igniter is at least one of above or below the predetermined signal strength value.

17. The system of claim 15 wherein the plasma arc igniter is configured to, when ignited, maintain the arc continuously at a temperature of at least about 1200 degrees Fahrenheit.

18. A method comprising:

accessing a system including a burner coupled to a fuel line to deliver fuel to the burner, a plasma arc igniter positioned adjacent to the burner and configured to ignite fuel emitted by the burner, and a valve configured to control a flow of fuel through the fuel line; and applying an input electrical signal to the plasma arc igniter to cause the plasma arc igniter to create an arc to ignite the fuel emitted by the burner;

measuring an electrical current signal indicating ignition signal strength of the input electrical signal;

sensing a quality of the electrical current signal; and if it is determined that the quality of the electrical current signal is determined to be greater than or less than a predetermined signal strength value, adjusting the input electrical signal.

19. The method of claim 18 wherein the input electrical signal is applied to the plasma arc igniter regardless of whether the burner is burning fuel.

20. The method of claim 18 wherein a control module is performing the measuring.

21. The system of claim 1 wherein the quality of the electrical current signal is related to a strength of the arc.

* * * * *